United States Patent [19]

Terracol et al.

[11] 4,001,738

[45] Jan. 4, 1977

[54] CIRCUIT INTERRUPTER HAVING AN ELECTROMAGNETIC REPULSION DEVICE

[75] Inventors: Claude Terracol, Eybens; Pierre Schueller, Grenoble, both of France

[73] Assignee: Merlin Gerin, Grenoble, France

[22] Filed: June 30, 1975

[21] Appl. No.: 592,017

[30] Foreign Application Priority Data

July 12, 1974 France ..... 74.24460

[52] U.S. Cl. ..... 335/16; 335/147; 335/195

[51] Int. Cl.[2] ..... H01H 75/10; H01H 77/10

[58] Field of Search ..... 335/16, 147, 195

[56] References Cited

UNITED STATES PATENTS

| | | | |
|---|---|---|---|
| 3,263,042 | 7/1966 | Dyer et al. | 335/16 X |
| 3,663,903 | 5/1972 | Kussy et al. | 335/16 |
| 3,663,905 | 5/1972 | Kussy et al. | 335/195 |
| 3,887,888 | 6/1975 | Bayles et al. | 335/16 X |

*Primary Examiner*—George Harris
*Attorney, Agent, or Firm*—Stevens, Davis, Miller & Mosher

[57] ABSTRACT

Circuit interrupter having a magnetic circuit energized by the current flowing through the interrupter and an induction plate that is movable with the movable contact of the interrupter. The abrupt rising of a fault current induces secondary currents in the induction plate which is located in the air gap of the magnetic circuit as long as the interrupter is in the closed-circuit position. The secondary currents tend to expel the induction plate from the air gap thereby moving the movable contact vigorously away from the magnetic circuit.

2 Claims, 5 Drawing Figures

CIRCUIT INTERRUPTER HAVING AN ELECTROMAGNETIC REPULSION DEVICE

This invention relates to circuit interrupters and more particularly to current-limiting circuit interrupters having high-speed opening means that are energized by the current flowing through the circuit interrupters.

The U.S. Pat. No. 3,824,508 discloses an electromagnetic repulsion device actuating the movable contact member of a circuit interrupter. The movable contact carries a conducting induction plate extending linearly between the pole faces of a magnetic circuit, i.e. in the air gap of said circuit, when the contacts are in the closed-circuit position. The portion of the movable contact carrying the major part of the current flowing under normal-service conditions through the circuit interrupter in the closed position thereof extends within the duct-shaped magnetic circuit so that this current energizes the magnetic circuit and generates a magnetic field in said air gap and in said induction plate. The abrupt rising of the current flowing through the circuit interrupter under fault-current conditions (for example further to a short-circuit) induces secondary currents in the induction plate which is eventually expelled from the air gap thereby urging the movable contact further inwards of the magnetic circuit. The therefrom resulting separation of the contacts of the circuit interrupter is instantaneously effective, even before high-speed tripping mechanisms can automatically operate the opening of the contacts.

It is an object of the invention to improve the known devices of the kind mentioned, more particularly by an enhancing of the energizing of the magnetic circuit and by a better positioning of the movable contact outside the magnetic circuit facilitating the mechanical supporting and the movement of the movable contact.

It is a further object of the invention to provide a configuration of the contacts permitting to adjoin an electrodynamic repulsion effect to the electromagnetic repulsion effect.

These and other objects, features and advantages of the invention will be more fully understood upon reading of the following description of some embodiments of the invention schematically shown in the accompanying drawings, in which.

Figure 3:
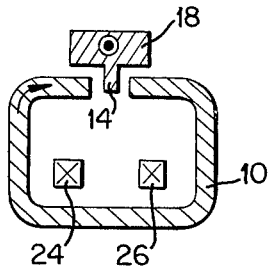
FIGS. 3 and 4 are views corresponding to FIGS. 1 and 2, respectively, of another embodiment of the invention.

In the Figures, a generally duct-shaped magnetic circuit 10 comprises a pair of pole faces defining a linearly extending air gap 12 of small width therebetween. An elongated induction plate of conducting material and equally of small width 14 is lodged in the air gap 12 as long as the contacts of the circuit interrupter (not shown in further detail) remain in the closed-circuit position thereof. The induction plate 14 is electrically connected at least at the end portions thereof to a coextensive linearly extending conductor 16 providing a return path for the secondary currents generated in the induction plate 14 under conditions that will be described in further detail hereinafter. The plate 14 and the return conductor 16 sandwich the bulk part of the movable contact bridge 18 formed by a bar which defines the main path for the current flowing through the circuit interrupter under normal-service conditions in closed-circuit position. This part 18 of the movable contact is located outside the magnetic circuit 10 so that the dimensions of the movable contact may be chosen substantially independently of the size of the magnetic circuit 10. The arrangement of the main part of the movable contact outside the magnetic circuit facilitates also the mechanical supporting, the access and the freedom of movement of this contact. In the shown embodiment, the induction plate 14 and the return conductor 16 form a cage imprisoning the main contact bar 18. The end portions of the bar 18 carry contacts cooperating with a pair of fixed contacts 20 and 22 connected to a pair of terminal current-supply conductors 24, 26, respectively, which traverse the magnetic circuit 10. It is easily seen that the conductors 24 and 26 carry currents flowing the the same direction so that the magnetic field generated by these currents is doubled and the produced repulsion force acting on the induction plate 14 increased proportionally.

Figure 2:
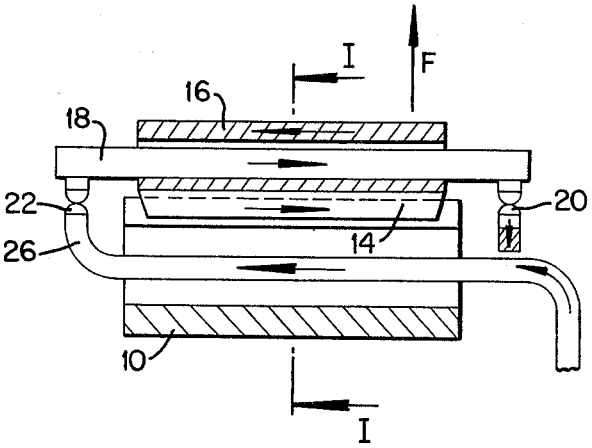
FIG. 2 is a sectional view taken along line II-II of FIG. 1.

The device operates as follows:

In the normal closed-circuit position of the contact 18, shown in FIG. 2, the current flows through the terminal conductor 26, contact 22, movable contact 18, contact 20 and terminal conductor 24, or inversely. The energizing currents flowing through the conductors 24 and 26 generate a magnetic field in the air gap 12 and in the conducting induction plate 14. In case of a rapid rising of the current under fault conditions, the rapid rising of the magnitude of the magnetic induction in the air gap 12 induces secondary currents in the induction plate 14 whereby the conductor 16 provides a return path for these currents. The secondary currents interact with the magnetic induction in the air gap and produce a repulsion force tending to expel the induction plate 14 upwards from the air gap 12 thereby urging the movable contact 18 (which may be electrically insulated from the parts 14 and 16) away from the magnetic circuit. The arrows represented in the FIGS. show the instantaneous directions of the currents and magnetic flux lines producing by their interaction the repulsion force F.

Figure 4:
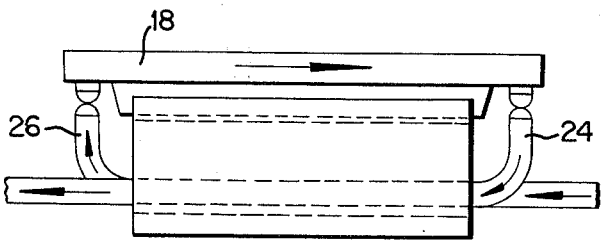
Figure 1:
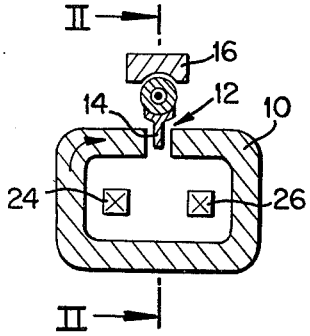
FIG. 1 is a sectional view taken along the line I-I of FIG. 2 of a first embodiment of the invention.

In the embodiment shown in FIG. 3 and 4, the movable contact constitutes a unitary structure of conducting material with the induction plate 14 and with the return conductor, the whole arrangement having a T-shape. According to the invention, the bulk part of the contact is located outside the magnetic circuit whereby the electromagnetic repulsion force tends to urge the movable contact further away from the magnetic circuit in case of fault currents.

Figure 5:
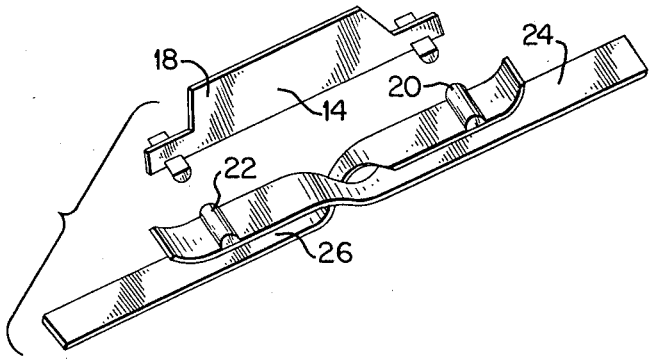
FIG. 5 is a perspective view of the contacts of a circuit interrupter according to a further embodiment of the invention.

FIG. 5 shows an embodiment wherein the flat terminal conductors 24 and 26 have a superposed interlaced configuration so as to form a flattened loop with the movable contact 14, 18 creating an electrodynamical repulsion effect enhancing the electromagnetic repulsion effect produced by the magnetic induction interacting with the induced secondary currents. It will be noted that the distance separating the conductors 24 and 26 from the movable contact 14, 18 is extremely small.

What we claim is:

1. A circuit interrupter having separable contacts and an electromagnetic repulsion device causing under predetermined fault-current conditions the separation of said contacts by imparting motion to a movable contact means of said contacts, said device comprising:

a magnetic circuit having closely spaced apart confronting pole faces defining a linearly extending air gap of small width therebetween, terminal conductor means supplying current to said circuit interrupter and linked with said magnetic circuit in magneticfield generating relation therewith, said movable contact means supporting an elongated conducting induction plate extending lengthwise between said pole faces in said air gap when said movable contact means is in closed-circuit position, said movable contact means defining therein a main current path for the current flowing under normal-service conditions through said movable contact means in the closed-circuit position thereof, said main current path extending adjacent said air gap outside said magnetic circuit in non-linked relation therewith, said movable contact means further defining a conducting portion linearly coextensive with said induction plate and located outside said air gap and said magnetic circuit in nonlinked relation with the latter to provide a return path for currents induced in said induction plate in such a manner that an abrupt rising of said fault current and the resulting rising of the magnitude of the magnetic field generated in said air gap by said terminal conductor means induce in said induction plate a secondary current linking said magnetic field and tending to repel said induction plate from said air gap to cause said moveable contact means to move away from said magnetic circuit.

2. A circuit interrupter according to claim 1, said terminal conductor means comprising two interlacing portions extending linearly adjacent said movable contact means to establish a loop-shaped current path producing an electrodynamic repulsion force acting upon said movable current means.

* * * * *